US006669439B2

(12) United States Patent
Kardasz et al.

(10) Patent No.: US 6,669,439 B2
(45) Date of Patent: Dec. 30, 2003

(54) VARIABLE FLOW IMPELLER-TYPE WATER PUMP WITH MOVABLE SHROUD

(75) Inventors: Gregory Kardasz, Richmond Hill (CA); David Mark Pascoe, Newmarket (CA)

(73) Assignee: Tesma International Inc., Concord (CA)

( * ) Notice: Subject to any disclaimer, the term of this patent is extended or adjusted under 35 U.S.C. 154(b) by 0 days.

(21) Appl. No.: 10/143,306

(22) Filed: May 10, 2002

(65) Prior Publication Data

US 2002/0192072 A1 Dec. 19, 2002

Related U.S. Application Data

(60) Provisional application No. 60/289,960, filed on May 10, 2001.

(51) Int. Cl.[7] ..... F04D 17/08
(52) U.S. Cl. ..... 415/131
(58) Field of Search ..... 415/131, 140, 415/156

(56) References Cited

U.S. PATENT DOCUMENTS 4,070,132 A * 1/1978 Lynch ..... 415/48
4,094,613 A 6/1978 Bracken
4,417,849 A 11/1983 Morris
4,752,183 A 6/1988 Sakuri
4,828,454 A * 5/1989 Morris et al. ..... 415/48
4,828,455 A 5/1989 Kinbara et al.
5,169,286 A 12/1992 Yamada
6,074,167 A * 6/2000 Olifirov et al. ..... 415/131

* cited by examiner

*Primary Examiner*—Ninh H. Nguyen
(74) *Attorney, Agent, or Firm*—Clark Hill PLC

(57) ABSTRACT

A variable-capacity water pump includes a housing having an impeller mounted on a rotatable shaft. The pump impeller has a plurality of vanes fixed to a flange. A circumferentially surrounding shroud is axially movable within the housing and may move between extended and retracted positions to surround or expose the vanes and therefore control the effective working capacity of the pump. At low engine speeds, the vanes are fully extended and the maximum amount of kinetic energy is transferred to the coolant. When the rotational speed increases above a certain pre-determined level, the shroud is pushed upwards towards the inlet opening and a portion of the vanes becomes covered. The capacity of the pump decreases and the power required to drive the pump also decreases. Both passive and active control means for the shroud are disclosed.

8 Claims, 6 Drawing Sheets

VARIABLE FLOW IMPELLER-TYPE WATER PUMP WITH MOVABLE SHROUD

RELATED APPLICATIONS

This application claim all the benefits and priority to U.S. provisional application No. 60/289,960, filed on May 10, 2001.

BACKGROUND OF THE INVENTION

1. Field of the Invention

The subject invention relates to a variable-capacity water pump with an impeller construction for use in automotive engines and the like.

2. Description of the Related Art

The cooling mechanism for an internal combustion engine used in an automobile normally comprises a coolant pump, commonly referred to as a water pump, of a centrifugal-type. The most common arrangement utilizes the engine rotation to drive a shaft via a belt connection between a driving pulley (connected to the crankshaft) and a driven pulley. The example shown in FIG. 1 shows a typical water pump 10 with the impeller 20 fastened to a rotating shaft 30 drivable by the pulley 40, which is attached to the engine crankshaft (not shown). The impeller 20 includes a flange 22 having several integral blades or vanes 24 projecting axially toward the inlet path 26. When the pulley 40 rotates, the drive shaft 30 rotates, and the vanes 24 similarly rotate. Coolant enters the passageway 50 and is thrown outward by centrifugal force of the rotating impeller 20 to an outlet port (not shown) via the outlet path 28.

Although this system is simple, it has the disadvantage of supplying a fixed capacity of coolant that is often unnecessarily large. This over-capacity arises because the pump output is sized to deliver a minimum flow amount of coolant at low engine speeds. At higher engine speeds, such as those experienced under normal highway driving conditions, the flow amount becomes excessive because it is directly proportional to engine speed, which is up to an order of magnitude greater. This leads to poor cooling efficiencies and increased power losses.

An alternative arrangement uses an electric motor instead of the engine to drive the impeller. However, this adds weight and cost because extra components are required, and because the capacity of the battery and generator needs to be increased, to supply the extra power needed by the motor.

U.S. Pat. No. 4,094,613, assigned to Sundstrand Corporation, discloses a variable output centrifugal pump utilizing a volute type diffuser in addition to vane diffusers. The variable flow is produced by a telescoping sleeve that closes or opens a main volute diffuser. In this design, a second volute diffuser is always open, so the range of control does not extend to zero flow output. Furthermore, the vane diffusers do not lie in a common plane, which leads to an undesirable increase in the physical volume of the pump.

U.S. Pat. Nos. 4,752,183 and 4,828,455, both assigned to Aisin Seiki Kabushiki Kaisha, propose a variable capacity impeller-type water pump that uses an axially movable thrust shaft and an attached disk or shroud with recesses through which the vanes protrude. A thermostat responds to temperature changes to move the thrust shaft and attached shroud over the vanes to vary the exposed area and therefore the quantity of coolant that flows through the water pump. This design relies on the accuracy of the thermostat, which can be suspect. It also poorly controls flow into the volute, allowing coolant to pass beneath the impeller. Furthermore, it does not allow for varying the pump capacity with the engine rotational speed.

U.S. Pat. No. 5,169,286, also assigned to Aisin Seiki Kabushiki Kaisha, proposes a variable capacity impeller-type water pump that uses coil springs and an attached disk plate or shroud with over-sized recesses through which the impeller vanes protrude with wide clearances. The effective height of the vanes, and hence the cooling capacity of the pump, is determined by the balance of forces exerted by the coil springs and the opposing pressure in the pressurized chamber formed between the impeller flange and the surrounding shroud. Unfortunately, this arrangement has several disadvantages, including unstable flow, unpredictable spring return characteristics, and very small pressure differentials, all of which result in a shroud position that is difficult to determine or control accurately.

SUMMARY OF THE INVENTION

The present invention provides a water pump construction with its capacity variable in accordance with an axially movable shroud that exposes a variable amount of impeller vane surface.

According to the present invention, a variable capacity coolant pump includes a pump body having a passage for coolant, a rotatable shaft projecting into the passage, a pump impeller having a flange extending radially outward from the rotatable shaft and a plurality of vanes axially projecting from the flange and configured to cause the flow of coolant through the passage, and a shroud positioned so that it moves from a position whereby the entire vane surfaces of the impeller are surrounded by the shroud, to a position whereby only a portion of the vane surfaces are surrounded, the position determined by either a torsional spring or externally actuated control unit. The external control unit can be integrated with other vehicle management control systems and can operate independently of engine speed, coolant temperature or fluid resistance pressure.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
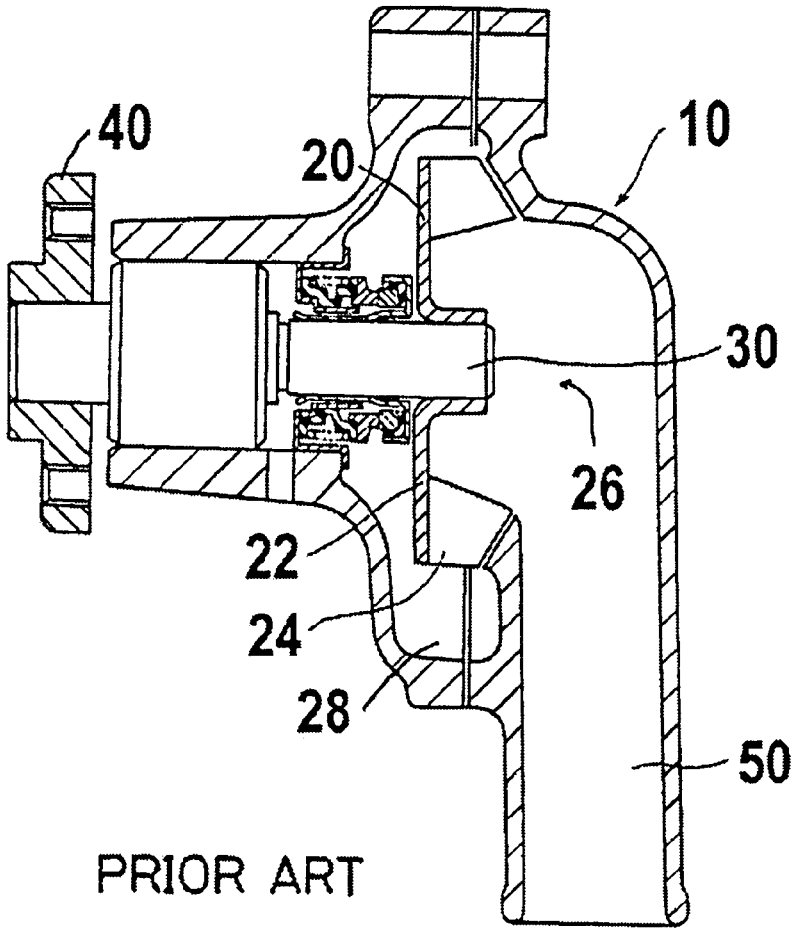
FIG. 1 is a cross-sectional view of a prior art water pump.
Figure 2:
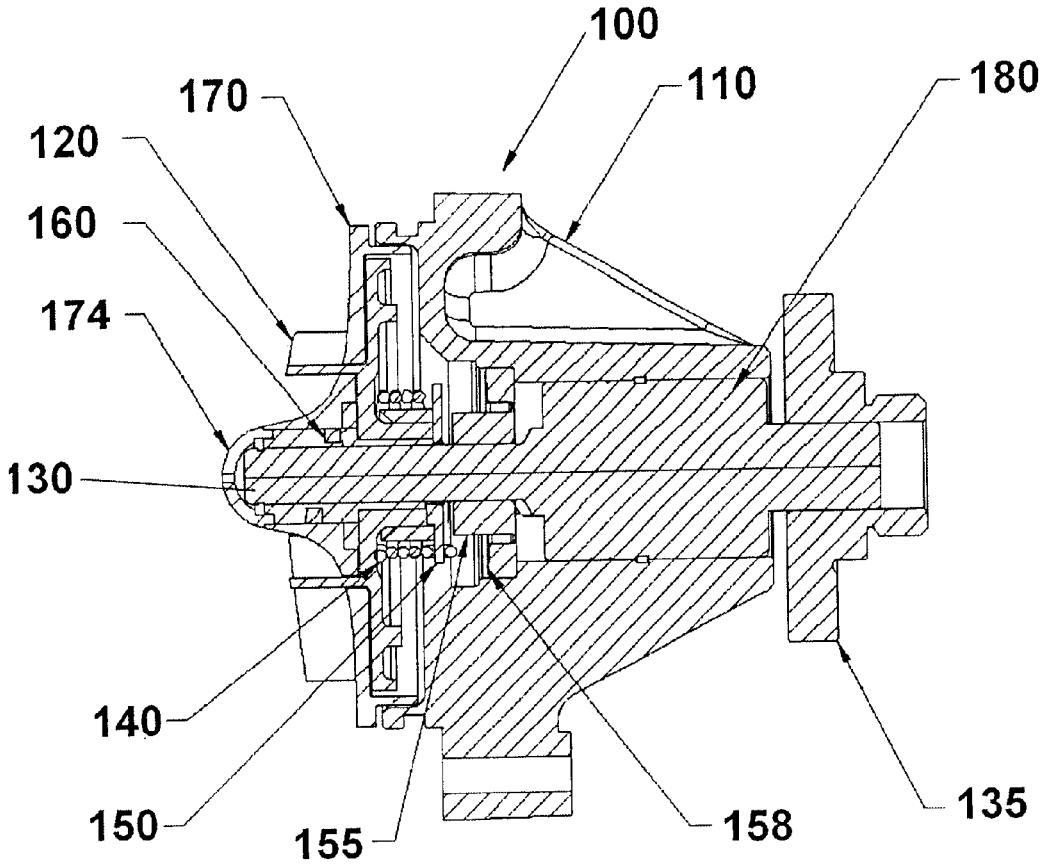
FIG. 2 is a cross-sectional view of a water pump according to the present invention, whereby the working height of the impeller vanes is maximized.
Figure 3:
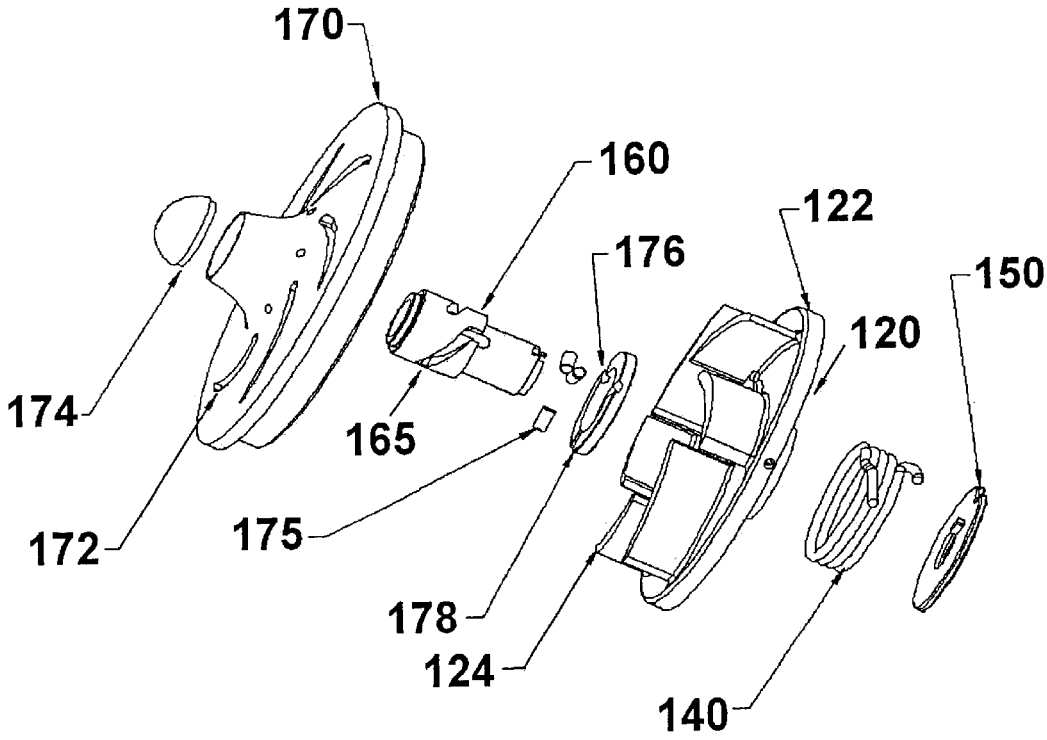
FIG. 3 is an exploded view of a water pump according to the present invention.

Referring to the Figures, wherein like numerals indicate like or corresponding parts throughout the several views, FIGS. 2 and 3 show an embodiment of a water pump 100 according to one aspect of the invention comprising a housing 110 enclosing a disk-shaped impeller 120. The impeller 120 includes a radial flange 122 having a plurality of integral vanes 124 projecting axially outward therefrom. The impeller 120 is fastened to a rotatable shaft 130 drivable by a pulley (not shown) bolted onto hub 135, whereby the pulley is belt driven from the engine crankshaft in a well-known manner.

The impeller 120 is initially held in place against a hard stop by an actuation spring 140 that exerts a torsional force, which opposes the drag torque created by the rotational movement of the impeller vanes through the coolant medium in the housing 110. The spring 140 is connected between a spring holder 150 and the impeller 120. A seal 155 and complementary adapter 158 are located behind the spring holder 150 to prevent leakage of the coolant medium from the housing 110. The adapter 158 may not be necessary, depending on the size of the seal 155.

The axial movement of the impeller 120 is controlled by the spring holder 150 and the top part of spiral sleeve 160. The impeller 120 is free to rotate over the spiral sleeve 160 in any direction within an angular range restricted by a hard stop located on the spring holder 150.

Further, an axially movable shroud 170, extending parallel to the axis of rotatable shaft 130, is circumferentially disposed around the impeller vanes 124. A plurality of grooves 172 is formed in the shroud 170. When the shroud 170 is assembled in place, all of the impeller vanes 124 are respectively inserted into each of the grooves 172 to project or extend beyond the surface of the shroud 170. The vanes 124 and grooves 172 are curved in the preferred embodiment to maximum the efficiency and force of the vanes, however, straight vanes and grooves are also within the scope of the invention. The shroud 170 also has an axially extending hollow portion 173 terminating in a cover or cup 174 wherein the hollow portion is designed to accommodate the spiral sleeve 160. Like the impeller 120, the shroud 170 slides axially over the spiral sleeve 160, but its movement is controlled by locking pins 175 sliding along grooves 176 in the shroud insert 178 and complementary grooves 165 in the spiral sleeve 160. The spring holder 150 is riveted or otherwise secured to the spiral sleeve 160, and both parts are preferably press fitted or otherwise secured onto the bearing shaft assembly 180.

Figure 4:
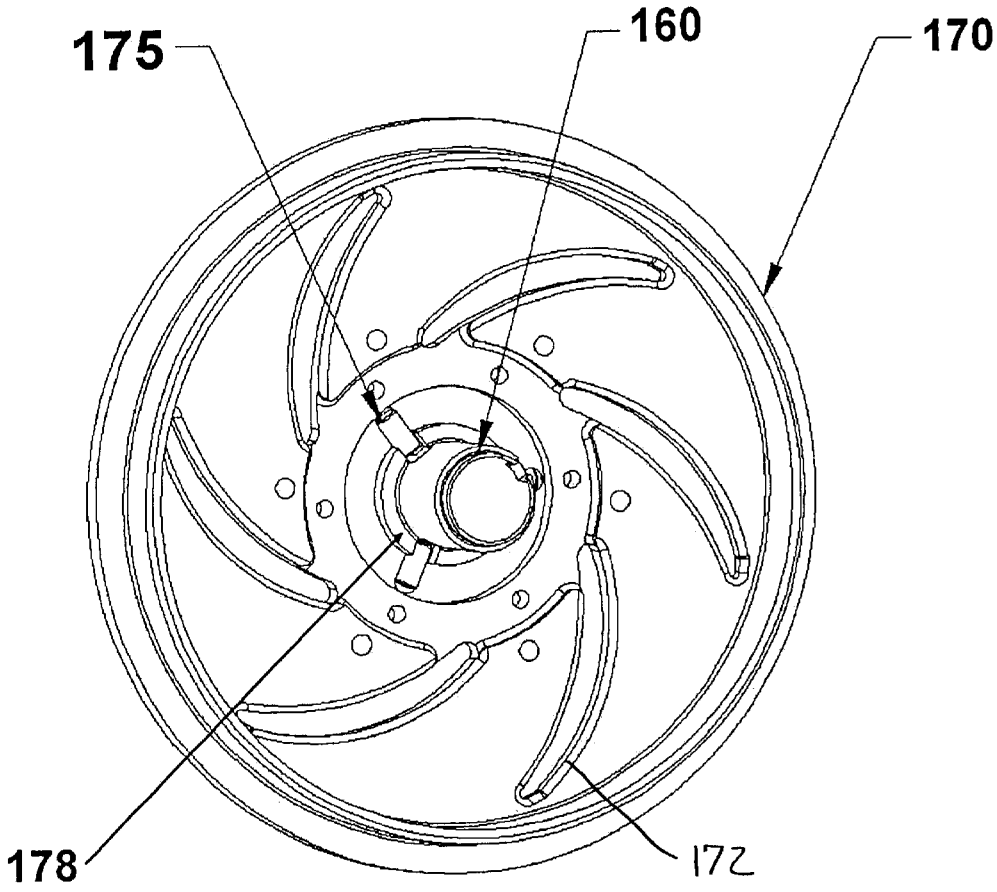
FIG. 4 is a perspective view of the invention showing the locking of the shroud via pins.

In operation, after the engine is first started, the rotational engine speed is low and the drag torque needed to move the impeller through the coolant is therefore also low and is easily opposed by the torsional spring 140. In this initial stage, the shroud 170 is held back in a retracted position as shown in FIG. 2, away from the inlet opening, by locking pins 175 located inside grooves 165 and 176 in the spiral sleeve 160 and shroud insert 178, respectively, as shown clearly in FIG. 4. This shroud position maximizes the exposed impeller vane surface and hence provides the maximum flow output at low engine speed.

Figure 5:
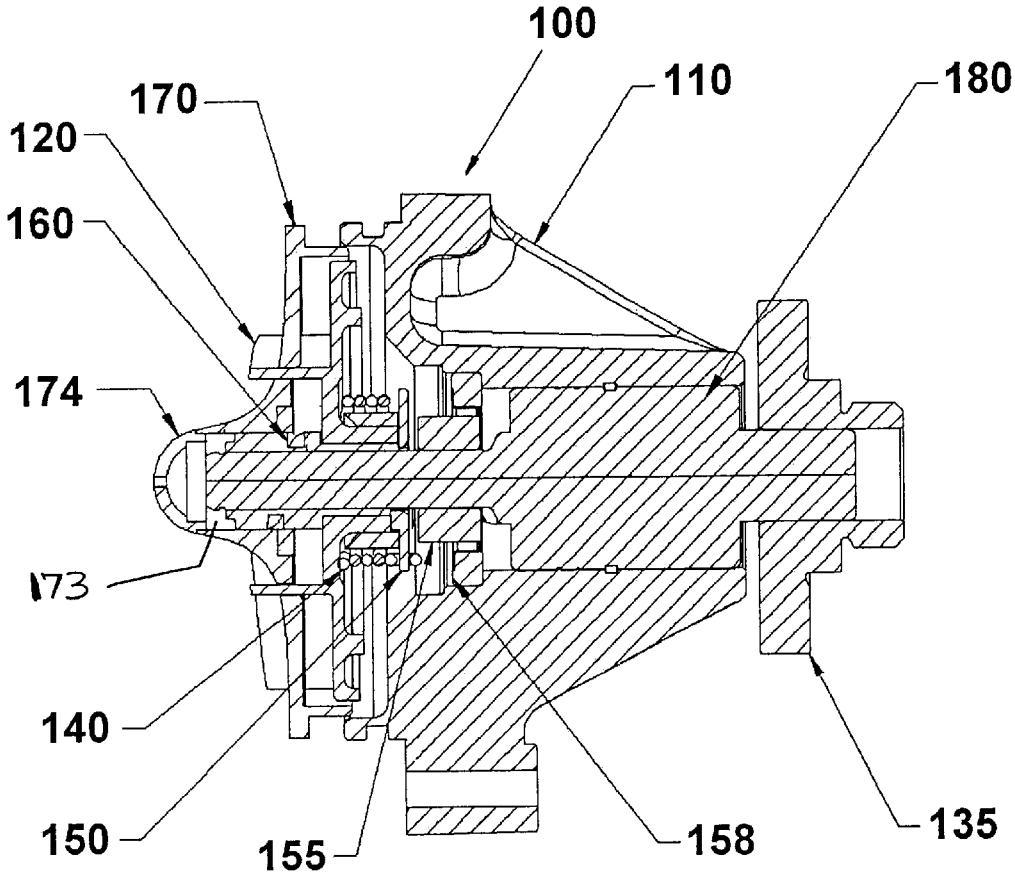
FIG. 5 is a cross-sectional view of a water pump according to the present invention, whereby the working height of the impeller vanes is minimized.

As engine speed increases, the drag torque on the impeller vanes 124 also increases due the direct connection described earlier. At a certain point, which can be controlled by the torsional spring characteristics, for example, the drag torque overcomes the torque of the torsional spring 140. When the impeller 120 and shroud 170 begin to change their relative angular position with the rotatable shaft 130, the shroud 170 is pushed upward by the pins 175, which follow the inside spiral grooves 165 of the spiral sleeve 160 to an extended position as shown in FIG. 5.

As the exposed vane surface decreases, the drag torque experienced due to fluid resistance also decreases. Also, the relative turning of the impeller 120 on the bearing shaft 180 increases the torque produced by the torsional spring 140, until it comes into equilibrium with the drag torque of the impeller 120 at the minimum flow configuration illustrated by FIG. 5.

During pump operation, the impeller drag torque is proportional to the flow value, which is easily measurable and does not change if the coolant temperature rises. Therefore, the force applied to the impeller is stable, predictable and precise. By using calibrated spring parameters, the shroud movement is smooth and controllable. Each pump spring can be calibrated for a specific vehicle cooling system.

Figure 6:
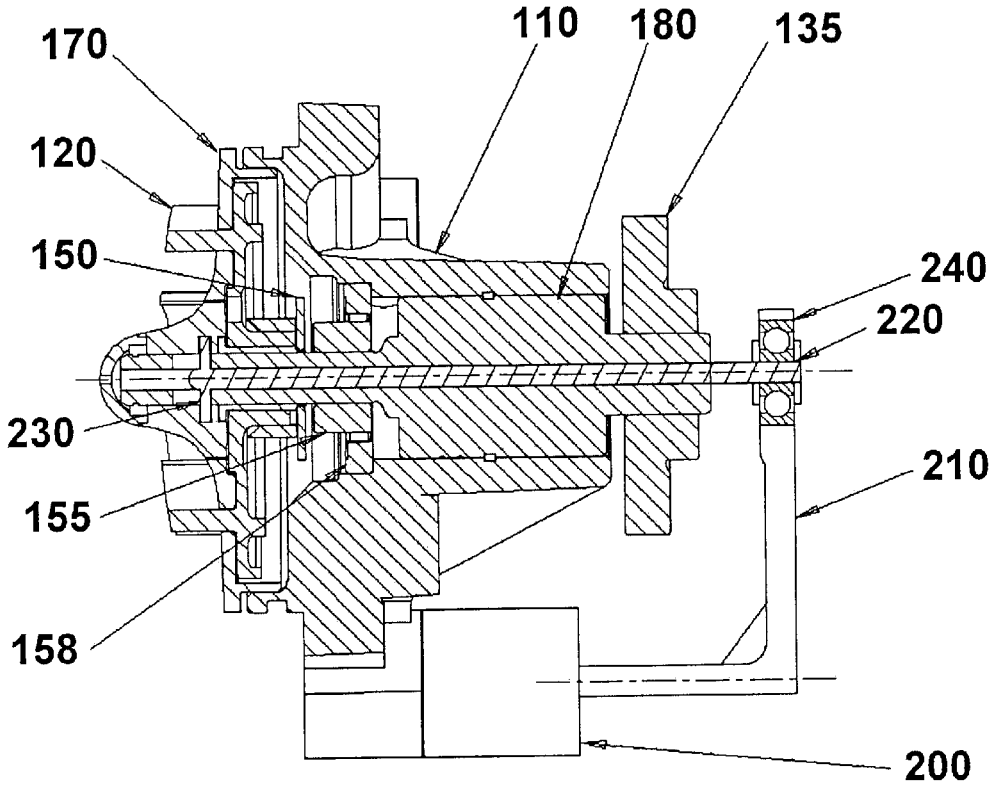
FIG. 6 is a cross-sectional view of a water pump according to a second embodiment of the present invention, illustrating an external actuator for actively controlling the position of the shroud.

The control system can also be active instead of passive. With this type of design, illustrated in FIG. 6, an external electric, mechanical or other type of actuator 200 is introduced with an actuation arm 210 and push rod 220 connecting to the shroud of the variable flow pump. The push rod 220 rotates at the pump shaft speed and its axial movement is restrained by a locating pin 230 within a cutout slot in the bearing shaft assembly 180. The pin 230 also controls the axial position of the shroud 170. The push rod 220 and actuation arm 210 are connected via a bearing 240 to reduce friction.

The shroud is controlled by an actuator and push rod arrangement that responds to sensor measurements to supply a sufficient quantity of coolant tailored to the actual need of the engine and without unwanted power loss caused by excessive flow. Because the actuator works independently of the cooling system, water pump operation can always be controlled, regardless of coolant pressure, temperature or engine speed. This ability creates a large energy savings, especially during the engine warm-up phase, and prevents engine overheating. The active system can work in a closed loop and can be controlled by the vehicle's on-board electronic control unit.

Having now fully described the invention, any changes can be made by one of ordinary skill in the art without departing from the scope of the invention as set forth herein. For example, the shroud insert 178 and shroud 120 could be produced as one molded element together with the locking pins 175 by using an insert molding type of process.

What is claimed is:

1. A variable capacity coolant pump comprising:

a pump housing for providing passage of coolant;

a rotatable shaft extending axially through said housing;

an impeller coupled to said shaft and having a flange extending radially outwardly from said shaft and a plurality of vanes projecting axially from said flange and configured to cause flow of the coolant through said housing;

a shroud operatively coupled to said shaft for axial movement therealong relative to said impeller between an extended position whereby the entire surface of said vanes are surrounded and covered by the shroud and a retracted position whereby only a portion of the vanes are surrounded and covered by the shroud for varying the amount of coolant flow through said housing by said impeller, said shroud including a cup-shaped body having a plurality of grooves therethrough for axially receiving said corresponding plurality of vanes during movement between said extended and retracted positions for variably surrounding and covering the surfaces of said vanes exposed to the coolant;

a sleeve rotatably journaled to said impeller and axially coupled to said shroud for guiding said shroud between said extended retracted positions in response to a change in angular position of the shroud and impeller relative to the shaft; and an actuator operatively coupled to said shroud for automatically controlling said axial movement of said shroud between said extended and retracted position for selectively controlling the amount of coolant flow through said housing by said impeller.

2. A variable capacity coolant pump as set forth in claim 1 further including a shroud insert secured to said shroud for supporting a plurality of radially extending locking pins and said sleeve including a plurality of spiral grooves for receiving said respective locking pins therein to guide said shroud axial along said sleeve between said extended and retracted positions.

3. A variable capacity coolant pump as set forth in claim 2 wherein said shroud insert includes a plurality of grooves for seating said locking pins and interlocking said locking pins with said shroud.

4. A variable capacity coolant pump as set forth in claim 3 wherein said shroud includes a hollow portion covered by a cup for allowing covered axial displacement of said shroud along said sleeve relative to said impeller.

5. A variable capacity coolant pump as set forth in claim 5 wherein said actuator includes a spring coupled to said impeller for exerting an torsional force on said impeller opposing the drag torque created by the rotation of said shaft and said impeller vanes.

6. A variable capacity coolant pump as set forth in claim 5 further including a spring holder for compressing said spring between said impeller and said spring holder.

7. A variable capacity coolant pump as set forth in claim 6 wherein said actuator includes a push rod extending axially through said shaft and locked to said shroud for axially displacing said shroud along said sleeve relative to said impeller between said extended and retracted positions.

8. A variable capacity coolant pump as set forth in claim 7 further including a controller for automatically controlling the actuation of said push rod and axial displacement of said shroud.

* * * * *

UNITED STATES PATENT AND TRADEMARK OFFICE

CERTIFICATE OF CORRECTION

PATENT NO. : 6,669,439 B2
DATED : December 30, 2002
INVENTOR(S) : Kardasz et al.

It is certified that error appears in the above-identified patent and that said Letters Patent is hereby corrected as shown below:

Column 4,
Line 67, add -- and -- beween “extended retracted”.

Column 5,
Line 5, add an -- s -- to “position” (i.e. it should be -- positions --).
Line 13, “axial” should be -- axially --.

Signed and Sealed this

Eighteenth Day of May, 2004

JON W. DUDAS
*Acting Director of the United States Patent and Trademark Office*